United States Patent [19]

D'Entremont et al.

[11] 4,136,323

[45] Jan. 23, 1979

[54] MINIATURE MOTOR PROTECTOR

[76] Inventors: John R. D'Entremont, 12 Alexander Rd., Foxboro, Mass. 02035; Jan A. Abcouwer, Borg Ewsum 72, Almelo, Netherlands

[21] Appl. No.: 802,406

[22] Filed: Jun. 1, 1977

[51] Int. Cl.[2] ..... H01H 61/02

[52] U.S. Cl. ..... 337/107; 337/102

[58] Field of Search ..... 337/107, 102, 105, 377

[56] References Cited

U.S. PATENT DOCUMENTS

| | | | |
|---|---|---|---|
| 4,015,229 | 3/1977 | Senor | 337/107 |
| 4,086,558 | 4/1978 | Pejouhy et al. | 337/102 |

*Primary Examiner*—Harold Broome

[57] ABSTRACT

A miniature motor protector device incorporates a flat, open-ended, electrically conductive metal can having a flange around its open end and having a terminal extending from the flange. A generally flat, electrically conductive metal lid is sealed to and electrically isolated from the can by an electrically insulating gasket which fits between the lid and the can flange. A thin electrically insulating film is disposed on the surface of the lid exteriorily of the can and a flat serpentine resistance heater element is positioned in heat transfer relation to the lid on top of the film. One end of the heater element is electrically connected to one end of the lid while the opposite end of the heater element extends from the opposite end of the lid to a second terminal. End portions of the lid and film are crimped over the heater element to secure the element and film to the lid. Two portions of the gasket are wrapped over respective opposite sides of the lid and portions of the can flange are crimped over the two gasket portions for securing the lid with its attached heater to the can. A thermally responsive bimetal member is mounted on the can bottom inside the can for movement in response to temperature change to engage and disengage an electrical contact on the inner surface of the lid for opening and closing an electrical circuit between the device terminals. The motor protector is particularly adapted for low cost, automated manufacture and for protecting a winding of a relatively small electrical motor.

5 Claims, 6 Drawing Figures

MINIATURE MOTOR PROTECTOR

Protector devices for electrical motors are commonly connected in motor winding circuits to be promptly responsive to the overload currents which result when certain fault conditions occur, thereby to interrupt the high currents which would tend to cause rapid overheating of the motor windings. It is also desirable to arrange the motor protectors to be directly responsive to increases in winding temperature, thereby to interrupt the winding circuits to protect the windings against relatively slower buildup of winding temperatures. For this latter purpose, the protectors should be small enough to be easily incorporated in the windings to be properly responsive to the occurrence of such overtemperature conditions. For this purpose, the protector should also be sealed to avoid contamination by winding varnish or the like and the protector materials should be resistant to high temperatures. The protector must also be adapted to be reliably manufactured at a cost which is compatible with the cost of the motor to be protected.

Where conventional motor protectors are proposed for protecting relatively small electrical motors, these objectives are difficult to achieve. That is, the protector devices tend to be too large to be easily incorporated in the motor windings. It is difficult to achieve sufficiently prompt response to the overcurrents which occur during a locked rotor fault condition while also achieving a desired operating temperature in response to slower buildup of winding temperature. Further, the thermally responsive member of the devices tend to have relatively small thermal mass such that, when the devices have interrupted the winding current in response to the occurrence of a fault condition, the thermally responsive member cools rapidly for permitting reclosing of the circuit. Thus the devices cycle on and off rapidly while the fault condition persists and as a result, the devices display relatively short service lives. Most important, such conventional devices have tended to be too expensive for use in protecting small electrical motors.

It is an object of this invention to provide a novel and improved motor protector device; to provide such an improved device which is particularly adapted for use in protecting relatively small electrical motors; to provide such a protector which is responsive to the occurrence of an overload current in a motor winding and which is also directly responsive to the occurrence of overtemperature conditions in the winding; to provide such a protector which is adapted to be reliably manufactured at a very low cost; and to provide such an improved, low cost protector device which displays a relatively long service life.

Briefly described, the novel and improved motor protector of this invention comprises a generally flat open-ended, electrically conductive metal can which has a flange around its open end and which preferably has an integral terminal extending from one end of the flange. A generally flat, electrically conductive metal lid is sealed to and electrically isolated from the open end of the can by an electrically insulating gasket which fits between the lid and portions of the can flange. A thin electrically insulating film is disposed on the outer surface of the lid and a flat serpentine heater element of electrical resistance material is positioned in heat-transfer relation to the lid on top of the insulating film. On end of the heater element is welded or otherwise electrically connected to the lid at one end of the lid. The remainder of the heater element then extends over the outer surface of the lid electrically separated from the lid by the insulating film and the opposite end of the element extends from the opposite end of the lid to serve as a second device terminal. In this way the heater is disposed in good heat-transfer relation to the lid. End portions of the lid and of the insulating film are crimped or folded back on the lid and heater element for securing the film and heater element to the lid. Two portions of the insulating gasket which isolates the lid from the can are also wrapped over respective opposite lateral sides of the lid and over portions of the heater element, and portions of the can flange are crimped or folded back on the lid over these insulating gasket portions for securing the lid with its attached heater to the can while maintaining the electrical isolation of the lid from the can. A thermally responsive bimetal member has one end welded or otherwise secured to the bottom of the can inside the can. The bimetal member extends in cantilever relation from the can bottom and carries a movable contact at its distal end, the member being adapted for snap-acting movement between two member positions in response to temperature change to engage and disengage the moveable contact with a contact mounted on the inner surface of the lid, thereby to open and close an electrical circuit between the device terminals.

When the terminals of this device are connected in series with a motor winding while the device itself is disposed within the motor winding in insulated relation to the winding, normal winding current is directed through the heater element, the lid, the contacts and the bimetal member to the can. If slow buildup of winding temperature should occur, the bimetal member is heated and is adapted to move to its open circuit position for interrupting the winding current. Similarly if an overload current occurs in the motor winding, heat generated by the resistance heater element, preferably in cooperation with heat generated in the bimetal member, rapidly heats both the bimetal member and substantial portions of the total thermal mass of the protector device to the operating temperature of the bimetal member. In this way, the bimetal member also opens the winding circuit in response to overload current in the winding. With this relatively large thermal mass of the protector device heated in this manner, the bimetal member remains above its reset temperature for a substantial period of time. Thus the protector device is adapted to cycle on and off at a relatively slow rate while the fault condition causing the overload current persists and the device is therefore adapted to display a relatively long service life. The construction of the protector device is advantageous in that the device is adapted for automated manufacture with high reliability and is adapted to be made with a very small size at very low cost. For example, the lid, heater, insulating film and lid contact are adapted to form a convenient and economical subassembly as are the can, the bimetal member, and the moveable contact of the device. The lid and can subassemblies are then easily and economically assembled together with the sealing and isolating gasket, the resulting final assembly then being adapted for convenient and economical calibration to provide a reliable, low cost motor protector of very small size.

Other objects, advantages and details of the novel and improved motor protector device of this invention appear in the following detailed description of preferred embodiments of the invention, the detailed description referring to the drawings in which.

Figure 1:
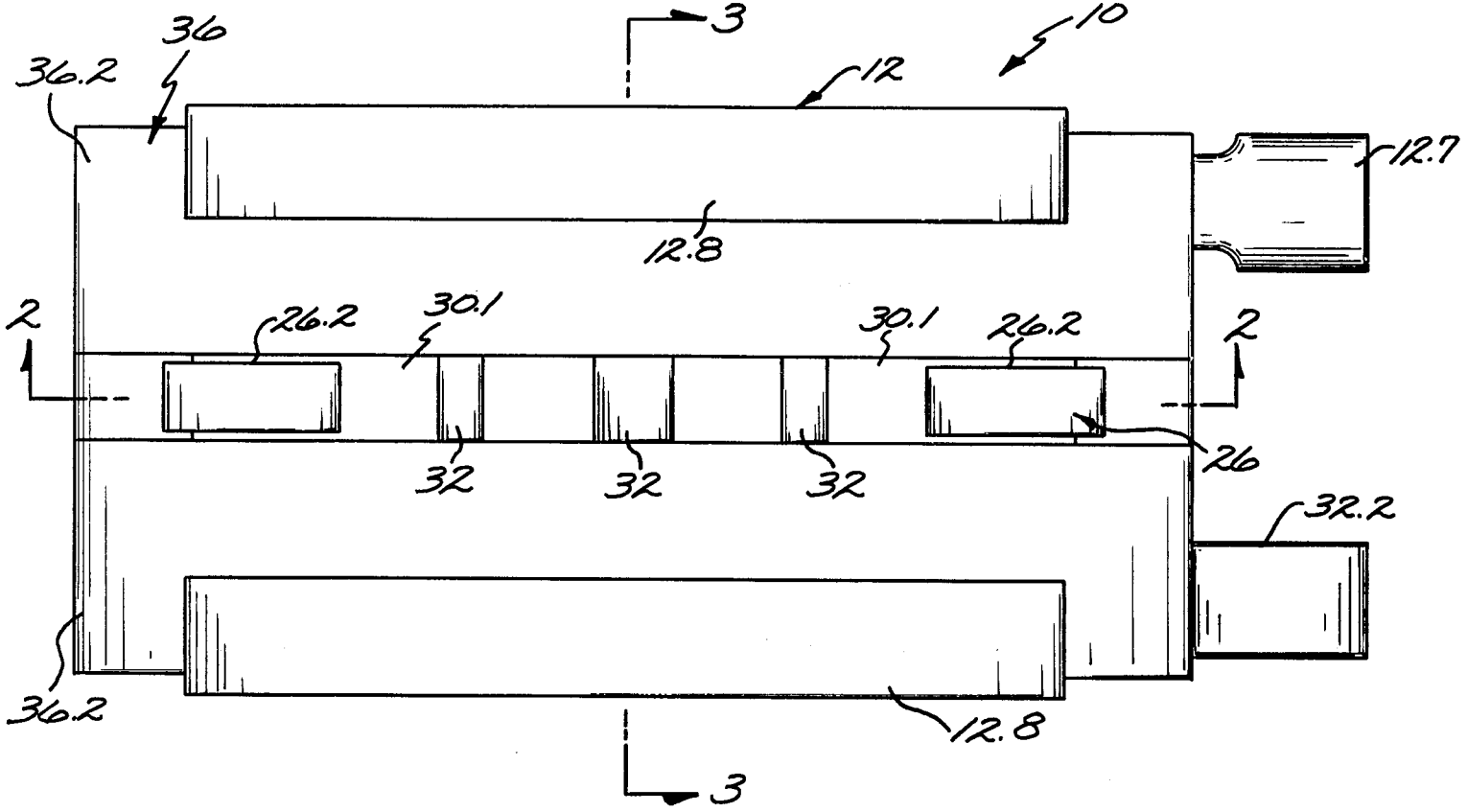
FIG. 1 is a plan view of the motor protector of this invention.
Figure 2:
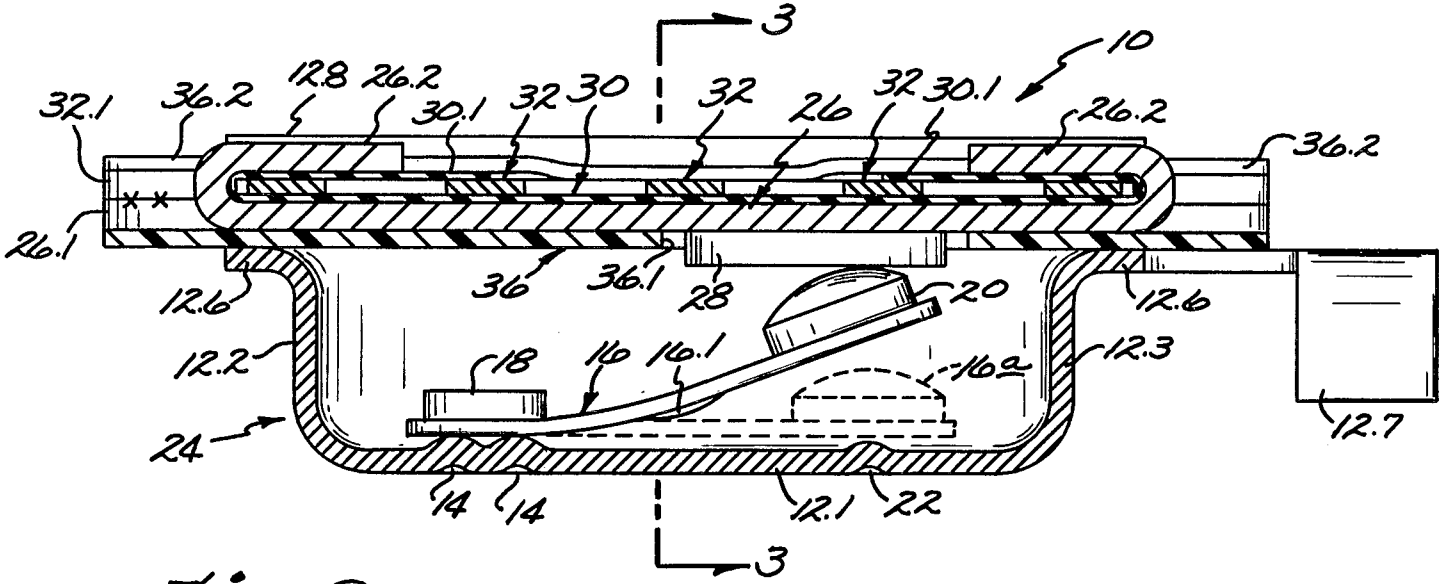
FIG. 2 is a section view along line 2—2 of FIG. 1.
Figure 3:
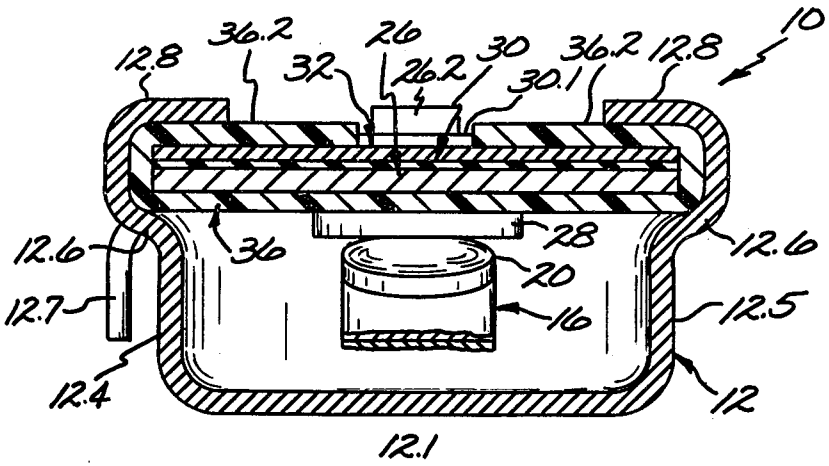
FIG. 3 is a section view along line 3—3 of FIG. 2.

Referring to the drawings, 10 in FIGS. 1–3 indicates the novel and improved motor protector of this invention which is shown to include a generally flat, rectangular, open-ended, electrically conductive metal can or housing part 12 having a bottom 12.1, a pair of end walls 12.2, 12.3 and a pair of side walls 12.4, 12.5 upstanding from the bottom, and a flange 12.6 extending around the rim or open end of the can. Preferably a portion 12.7 of the flange extends from the can to serve as an integral device terminal. Indentations 14 are preferably formed in the can bottom to provide weld projections inside the can and a resilient, thermally-responsive thermostat bimetal member 16 is projection welded to the can bottom, preferably using a conventional weld button 18 as shown in FIG. 2, so that the bimetal member extends in cantilever relation from the can bottom to support a moveable electrical contact 20 of conventional contact material at the distal end of the bimetal member. The bimetal member 16 preferably has a dished portion 16.1 intermediate its ends so that the member is adapted to move with snap action from a first position shown in solid lines in FIG. 2 to a second position shown by broken lines 16*a* when the bimetal member is heated to a selected actuating temperature. The bimetal member is also adapted to move with snap action back to said first position when the bimetal member subsequently cools to a relatively lower, reset temperature. Preferably an additional indentation 22 in the can bottom provides a stop for limiting movement of the bimetal member as the member snaps to said second member position. In this arrangement, the can 12, bimetal member 16, weld button 18, and contact 20 form an easily manufactured and easily handled subassembly 24 in which the side and end walls of the can protect the bimetal member during subsequent handling of the subassembly. Alternately of course other thermally-responsive switch means of a conventional type are incorporated within the protector device for electrically connecting and disconnecting the lid from the can or the occurrence of an overload current or overtemperature condition in the protector.

Figure 4:
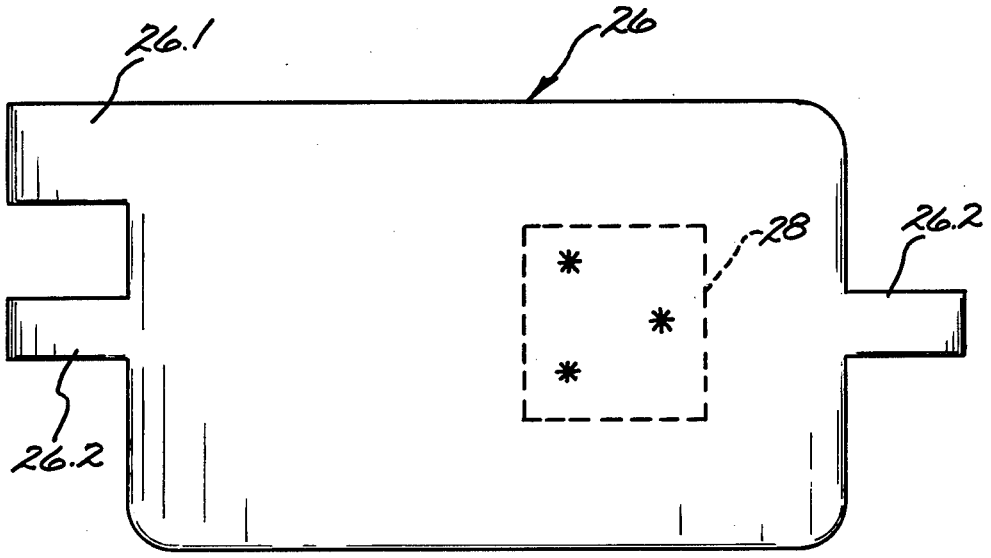
FIG. 4 is a plan view of the lid incorporated in the device of FIG. 1.
Figure 5:
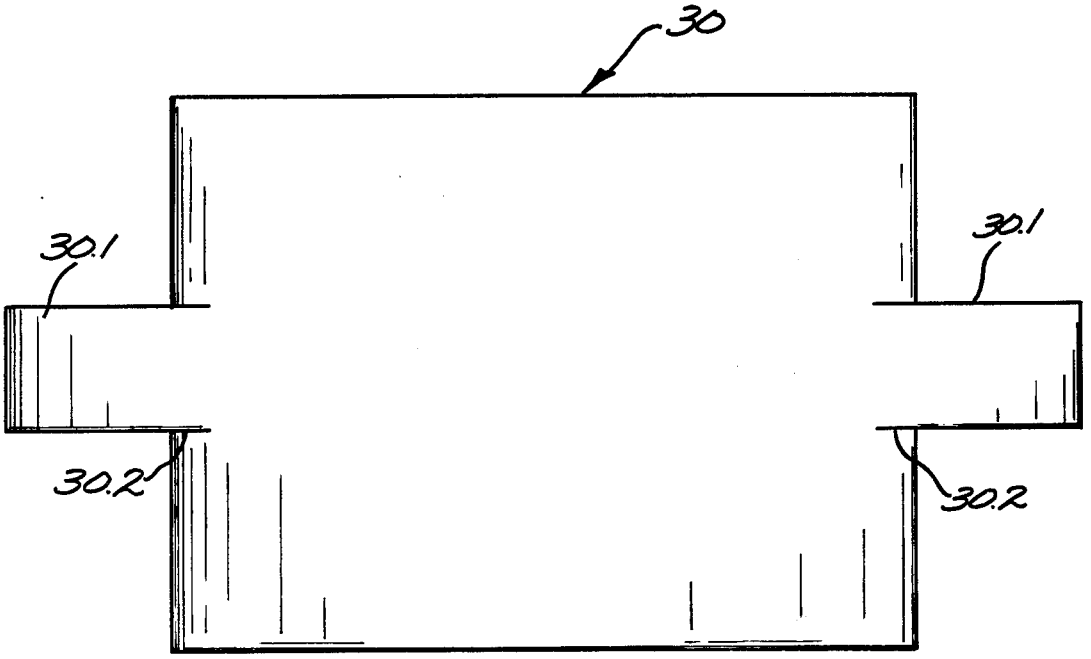
FIG. 5 is a plan view of an insulating film incorporated in the device of FIG. 1.

The motor protector 10 also includes a generally flat, electrically conductive metal lid or cover plate housing part 26 and an electrical contact 28 is secured to one side of the lid by welding or the like as is best shown in FIGS. 2 and 3. In accordance with this invention, the lid is provided with a connector part 26.1 at one end of the lid and is also initially provided with a pair of crimpable portions 26.2 extending from respective opposite ends of the lid as shown in FIG. 4. A thin film or sheet 30 of an electrical insulating material such as a polyamide material or the like is also provided with a configuration generally similar to that of the lid as is shown in FIG. 5. That is, the film is provided with extending portions 30.1 at opposite ends of the film and preferably has slits 30.2 formed where the extending film portions 30.1 join the body of the film.

Figure 6:
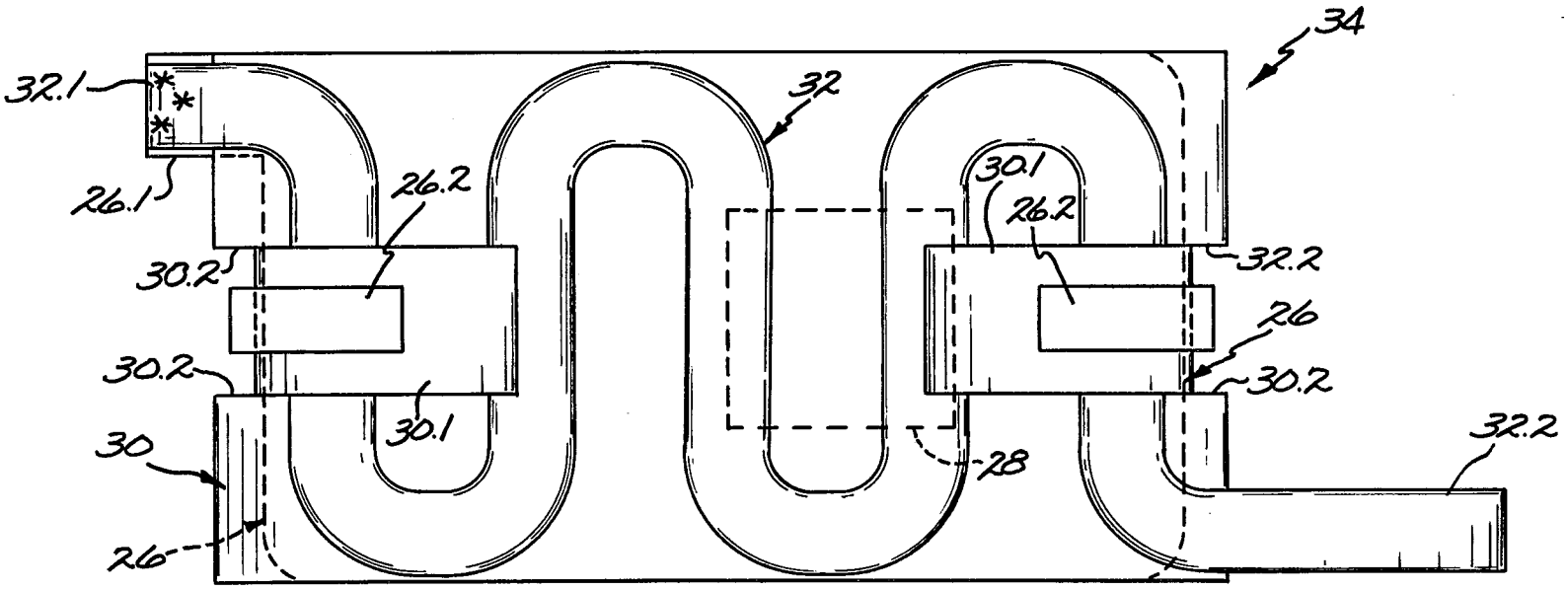
FIG. 6 is a plan view of subassembly of the lid and film of FIGS. 4 and 5 with a resistance heater incorporated in the device of FIG. 1.

In accordance with this invention, the film 30 is fitted against a second side of the lid 26 opposite from the lid contact 28 as shown in FIG. 6 and a flat serpentine heater element 32 of an electrical resistance material is disposed on top of the film 30 to be in good heat transfer relation to the lid 26 while being electrically separated from the lid throughout much of its length. Preferably for example, one end 32.1 of the heater element is electrically connected to one end of the lid as by welding the heater end to the lid connector part 26.1, the remainder of the heater then extending across the lid in good heat transfer relation to the lid while being electrically separated from the lid by the film 30 so that the opposite end 32.2 of the heater extends from the opposite end of the lid to serve as a second device terminal. The heater element is formed of any conventional electrical resistance material but is desirably formed of a nickel-chromium alloy or the like having a resistivity on the order of from 100 to 900 ohms per circular mil foot. As shown in FIG. 6, the crimpable extending portions 26.2 of the lid are crimped or folded back over the second side of the lid to also fold the extending portions 30.1 of the insulating film 30 over the portions of the heater element 32, thereby to secure the heater element and the film to the lid while maintaining electrical separation of the heater from the lid except at the lid connector part 26.1. In this way the heater, film, and lid are easily and economically joined together in a subassembly 34 and the heater is held flat against the lid and film for protecting the heater during subsequent handling of the lid subassembly.

In accordance with this invention, the lid subassembly 34 is secured to the can subassembly to form the protector device 10. That is, the lid 26 is sealed to, and electrically isolated from, the can 12 by means of an electrically insulating gasket which is fitted between the lid 26 and the can flange 12.6. Preferably, as is best shown in FIG. 2, the gasket 36 is provided with an opening 36.1 which fits over the contact 28 located on the first or inner surface of the lid 26. Lateral edge portions 36.2 of the gasket are then wrapped or folded over the lateral edges of the lid 26 and over portions of the heater element 32. Corresponding lateral portions 12.8 of the can flange are then crimped or folded over on top of the gasket portions 26.2 for securing the lid subassembly 34 to the can subassembly 24 and for compressing the gasket on either side of the lid between can flange portions 12.6 and 12.8. Typically the gasket 36 is formed of a sheet of polyethylene terephthalate or the like having a coating of thermosetting adhesive material on both sides of the sheet. Crimping of the flange portions 12.8 of the can over the lateral edge portions 36.2 of the gasket compresses the gasket firmly against the lid 26 and the can flange 12.6 as well as against the can flange 12.8 and the heater element 32. The resulting assembly is then heated for curing the thermosetting adhesive for securely sealing the lid assembly to the can assembly while maintaining the electrical isolation of the lid from the flange and for further securing the heater element to the outer surface of the lid. Alternately, where the gasket 36 is formed of a compressible material such as a polyamide or the like, the compression of the gasket by the can flange portions 12.8 is also adapted to provide tight sealing of the protector device. As the lid and can assemblies are secured together in this manner, the moveable contact 20 is also engaged with the lid contact 28 for normally closing an electrical circuit between the device terminals. After such assembly, the can bottom is deformed where necessary, at the location of the indentations 14 for example, so that the moveable contact normally bears against the lid contact 28 with desired contact pressure and so that the precise actuating temperature of the bimetal element is determined in conventional manner, thereby to calibrate the motor protector 10.

In this construction, the device terminals are adapted to be connected in series with a motor winding and, when enclosed in a heat-shrunk tube of electrical insulating material in conventional manner, the protector is easily incorporated within the winding of a relatively small motor. Accordingly, on the occurrence of an overload current in the winding, heat generated in the heater element 32 promptly heats the thermally responsive member 16 to its operating temperature so that the member moves with snap action to the second position shown in FIG. 2 for interrupting the winding circuit. The thermally responsive member is also adapted to be directly responsive to increases in winding temperature for interrupting the winding circuit. Thereafter, upon cooling of the thermally responsive member 16 to its reset temperature, the member automatically snaps back to its original position for reclosing the winding circuit.

The motor protector construction is such that the device is adapted for low cost automated manufacture. Each of the protector components is individually of low cost and the components are easily assembled together to provide a reliable, easily calibrated device. The protector is sealed in a reliable manner to assure that contaminants such as winding varnish or the like are excluded from the device, and the device components, particularly those which serve an electrical insulating function, are adapted to be made of low cost materials with assurance that they will be fully resistant to the temperatures to which they will be subjected. In particular, the heater disposition is such that it is adapted to heat the bimetal member to its actuating temperature on the occurrence of an overload current in the heater without requiring heater output which is so high as to require the use of ceramic or other heater insulating materials which would be difficult to incorporate in the heater construction. The device is also adapted to be of very small size, typically being less than 1 inch long, less that one-half inch wide, and less than one-quarter inch thick.

Most important the protector is also adapted to display very desirable operating characteristics particularly for use in relatively small electrical motors. For example by selection of the appropriate heater element materials and properties, the device is adapted to provide prompt response to locked rotor currents or the like in the range from 2.8 to 15.0 amperes while also displaying suitable locked rotor current to ultimate trip current ratios. The protector also displays longer cycle times and significantly improved service life. That is, where the heater element is adapted to heat the thermally responsive member 16 for promptly opening the protector circuit on the occurrence of overload currents as above described, the heater element also heats the thermal mass of the lid, and portions of the can and contacts to a corresponding temperature, whereby subsequent cooling of the thermally responsive element to its reset temperature is significantly retarded. Typically, for example, the cooling, or cycle-off, time of the device is 3 to 6 times longer than the initial response, or first-on, time of the device, whereby the service life of the device is substantially improved.

It should be understood that preferred embodiments of this invention have been described by way of illustrating the invention, but that this invention includes various modifications and equivalents of the disclosed embodiments. For example, the lid assembly is adapted to be secured to the can assembly with an alternate orientation so that the device terminals extend from opposite ends of the motor protector. This invention includes all modifications and equivalents of the disclosed embodiments falling within the scope of the appended claims.

What is claimed:

1. A motor protector comprising an open-ended electrically conductive metal can having a flange extending around the open can end, an electrically conductive lid for the can, electrically insulating gasket means disposed between the lid and flange for sealing the can and electrically isolating the lid from the can, thermally responsive switch means disposed within the can for electrically connecting and disconnecting the lid and can in response to selected temperature changes, said gasket means having a pair of lateral portions folded over respective opposite edges of the lid and said flange having a pair of portions folded over said respective lateral portions of the gasket means for securing the lid to the can while maintaining electrical isolation of the can from the lid, characterized in that an electrical resistance heater means is disposed in heat-transfer relation to an exterior surface of the lid for selectively heating the switch means, and said lateral portions of the gasket means are fitted over respective portions of said heater means for securing the heater means to the lid while maintaining electrical isolation of the heater means from the can.

2. A motor protector as set forth in claim 1 having portions of the lid folded over the heater means for additionally securing the heater means to said exterior surface of the lid.

3. A motor protector as set forth in claim 2 having electrically insulating film means disposed between the lid and a substantial portion of the heater means, the heater means having one end thereof electrically connected to the lid at one end of the lid and having its opposite end extending from the opposite end of the lid to provide one terminal means for the motor protector.

4. A motor protector comprising an open-ended electrically conductive metal can having a bottom, side and end walls upstanding from the bottom, and a flange extending around the open can end, a thermally responsive bimetallic member secured at one end to the can bottom inside the can to extend in cantilever relation from the can bottom, said bimetallic member having a dished portion intermediate its ends to be moveable with snap action from a first position to a second position in response to heating of the member to a selected temperature and to be moveable with snap action from said second position to said first position on subsequent cooling of the member to a relatively lower temperature, moveable contact means mounted in the distal end of the bimetallic member, an electrically conductive lid for the can, electrically isolating gasket means disposed between the lid and the can flange sealing the can and electrically isolating the lid from the can, complementary contact means mounted on an inner surface of the lid to be engaged by the moveable contact means for closing a circuit when the bimetallic member is in said first position thereof, an electrically insulating film covering a substantial portion of an exterior surface of the lid, and a flat serpentine electrical resistance heater element disposed on the film in heat transfer relation to the lid for selectively heating the bimetallic member to said selected temperature on the occurrence of a selected current in the heater element, said element having one end thereof electrically connected to the lid and having its other end extending from the lid to provide one terminal means for the protector, said gasket means having a pair of lateral portions folded over respective opposite edges of the lid and over respective portions of the heater element, and said can flange having a pair of portions folded over said respective lateral gasket portions securing the heater element to the lid and the lid to the can while maintaining electrical isolation of the can from the heater element and the lid.

5. A motor protector as set forth in claim 4 having portions of the lid and insulating film folded over the heater element for additionally securing the heater element to the exterior surface of the lid while electrically separating said lid portions from the heater element.

* * * * *